US006916990B2

(12) United States Patent
Behziz et al.

(10) Patent No.: US 6,916,990 B2
(45) Date of Patent: Jul. 12, 2005

(54) HIGH POWER INTERFACE

(75) Inventors: Arash Behziz, Agoura, CA (US); Frank Parrish, Simi Valley, CA (US); Donald Thompson, Thousand Oaks, CA (US); Arthur LeColst, Moorpark, CA (US); Keith Breinlinger, Hampstead, NH (US); Brian Brecht, Newbury Park, CA (US); Gerald H. Johnson, Andover, MN (US)

(73) Assignee: Teradyne, Inc., Boston, MA (US)

( * ) Notice: Subject to any disclaimer, the term of this patent is extended or adjusted under 35 U.S.C. 154(b) by 289 days.

(21) Appl. No.: 10/261,738

(22) Filed: Sep. 30, 2002

(65) Prior Publication Data

US 2004/0060725 A1 Apr. 1, 2004

(51) Int. Cl.[7] ..... H01B 7/08
(52) U.S. Cl. ..... 174/117 FF
(58) Field of Search ..... 174/117 F, 117 FF, 174/99 B, 72 A, 72 B, 261, 262

(56) References Cited

U.S. PATENT DOCUMENTS

| | | | | |
|---|---|---|---|---|
| 3,448,355 A | * | 6/1969 | Ahearn, Jr. et al. | 361/306.3 |
| 3,662,088 A | * | 5/1972 | Wright et al. | 174/72 B |
| 3,708,609 A | * | 1/1973 | Iosue et al. | 174/72 B |
| 3,708,610 A | * | 1/1973 | Kozel et al. | 174/72 B |
| 3,818,119 A | * | 6/1974 | Sutherland et al. | 174/72 B |
| 4,085,502 A | | 4/1978 | Ostman et al. | |
| 4,401,844 A | | 8/1983 | Fleuret | |
| 5,051,542 A | | 9/1991 | Hernandez | |
| 5,306,874 A | | 4/1994 | Biron | |
| 5,579,217 A | | 11/1996 | Deam et al. | |

OTHER PUBLICATIONS

AMP Product Brochure, "AMPOWER Wave Crimp System," Catalog 82271, Jul. 193, pp. 1–12.
AMP Product Brochure, "AMPOWER Wave Crimp System," Catalog 82271, Jun. 1997, pp. 1–12.

* cited by examiner

*Primary Examiner*—Chau N. Nguyen

(57) ABSTRACT

In one embodiment a high power interface apparatus is provided having a multilayer laminated cable including force conductor planes having flush and recessed portions and return conductor planes having flush and recessed portions. The flush portions of the conductor planes extend to a contact end of the laminated cable and the recessed portions are removed from the contact end. The flush portions are aligned along axes at the contact end. The flush portions of the return conductor planes are aligned at the contact end along axes aligned within recessed portions of the force conductor planes. A dielectric material separates the force and return conductor planes. Surface contact pads may be provided on the contact end including force contact pads, each contacting and extending along aligned flush portions of the force conductor planes, and including return conductor pads, each contacting and extending along aligned flush portions of the return conductor planes. The contact pads may be formed by plating the end, and then scoring. The multilayer laminate cable can be formed with a rigid portion near the contact end and a flexible portion between the cable ends. In some embodiments the force and return conductor planes of the flexible portion extend to the ends of the cable while the rigid portion can be formed with additional force and return conductor planes. Through vias may be included at the rigid portion to electrically couple the force conductor planes together and to electrically coupling the return conductor planes together.

21 Claims, 8 Drawing Sheets

HIGH POWER INTERFACE

BACKGROUND

Automatic test equipment or ATE is used to test semiconductor or other type devices at various stages of manufacture. Typically, an ATE tester supplies power and test signals, from instrument cards located in a test head, to a device interface board or DIB for routing to selected pins of a device under test or DUT.

As devices continue to operate at ever increasing speeds, and include ever increasing numbers of transistors, providing a stable source of power during dynamic modes of operation becomes problematic. The ATE power supply often responds to dynamic current changes of, for example, 300 amperes, within a few picoseconds. At these levels of current switching performance, inductance and minute resistances pose significant problems, tending to inhibit changes in current, thereby affecting the device-under-test. Typically, during dynamic modes of power supply operation, responsive high current waveforms are supplied by the instrument card to the DIB via a bus bar, or a heavy gauge wire, such as for example a 0.4 AWG cable.

Large diameter cables and bus bars are bulky and not easily maneuvered. This can be undesirable in certain ATE applications. In certain applications, for example, it may influence the positioning of the connector when mating with the DIB, or it can otherwise hinder operations nearby. Further, in precision testing applications, a corresponding return line is also provided between the instrument card and the DIB. Thus, a pair of cables is used, increasing such effects. In a paired force/return cable arrangement, mutual inductance is a concern. Since inductance sums along the length of the cable, this can limit high frequency response. Also, reliable, low inductance connection is not easily provided at low cost.

Conventional laminated foil straps are not easily manufactured to provide reliable interconnection at low cost, and do not provide high current interfacing with extremely low inductance. Such is often desired by ATE testers to provide precision testing of DUT's capable of operating at very high frequency.

SUMMARY

In one embodiment a high power interface apparatus is provided having a multilayer laminated cable including force conductor planes having flush and recessed portions and return conductor planes having flush and recessed portions. The flush portions of the conductor planes extend to a contact end of the laminated cable and the recessed portions are removed from the contact end. The flush portions are aligned along axes at the contact end. The flush portions of the return conductor planes are aligned at the contact end along axes aligned within recessed portions of the force conductor planes. A dielectric material separates the force and return conductor planes.

In certain embodiments, surface contact pads are provided on the contact end. The surface contact pads include force contact pads, each contacting and extending along aligned flush portions of the force conductor planes, and also include return conductor pads, each contacting and extending along aligned flush portions of the return conductor planes. The contact pads may be formed by depositing and removing conductor material at the contact end of the cable. In some implementations, the end of the cable may be plated, and then scored, such as with a drill to define the pads. The recessed portions of the conductor planes may be formed wider than the flush portions to facilitate formation of the contact pads.

The multilayer laminate cable may be formed with a rigid portion near the contact end and a flexible portion between the cable ends. In some embodiments the force and return conductor planes of the flexible portion extend to the ends of the cable with the rigid portion having with additional force and return conductor planes. In such an embodiment, through vias may be provided in the rigid portion, to electrically couple the force conductor planes together and to electrically couple the return conductor planes together. Depending on the thickness of the rigid portion and the fabrication technique, the rigid end portion may be sliced into sub-portions to facilitate formation of the vias, and then recombined if desired. An alignment means such as holes may be provided at the cable end to facilitate recombination.

Some embodiments may have the contact pads formed at both ends of the cable, while other embodiments may have contact tabs extending from a second end of the laminated cable. In such an embodiment, the force and return conductor planes are integrally formed with contact tabs. The contact tabs of the force and return conductor planes are in a staggered configuration such that the force contact tabs are located on one side of an axis of separation and the return contact tabs are located on the other side of the axis of separation. A rigid end connector may be provide thereon, adapted to receive a plurality of the contact tabs in electrically isolated portions so that the contact tabs from one side of the axis of separation are received in one of the electrically isolated portions and the contact tabs from the other side of the axis of separation in an other of the electrically isolated portions. In still other embodiments both ends of the laminated cable may have the contact tabs.

BRIEF DESCRIPTION OF THE DRAWINGS

FIG. 11 FIG. 9 shows a top view of partially constructed laminated cable in accordance with a possible embodiment of the present invention.

DETAILED DESCRIPTION

Figure 1:
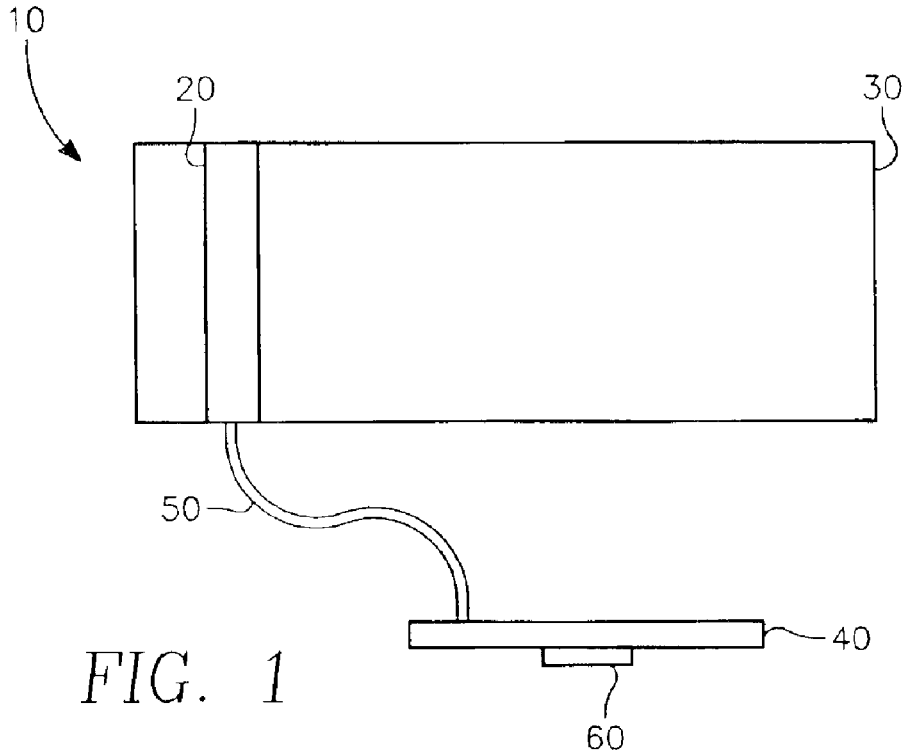
FIG. 1 is a simplified illustration of a test head-to-DIB interface.

FIG. 1 is a simplified illustration of a test head-to-DIB interface 10. An instrument card 20 is shown seated within a test head 30. The instrument card 20 is capable of providing changes in current supplied to a DIB 40 via a high power interface 50. The DIB distributes the current to a DUT 60. The high power interface 50 may include planar type conductors separated by dielectric layers.

Figure 2:
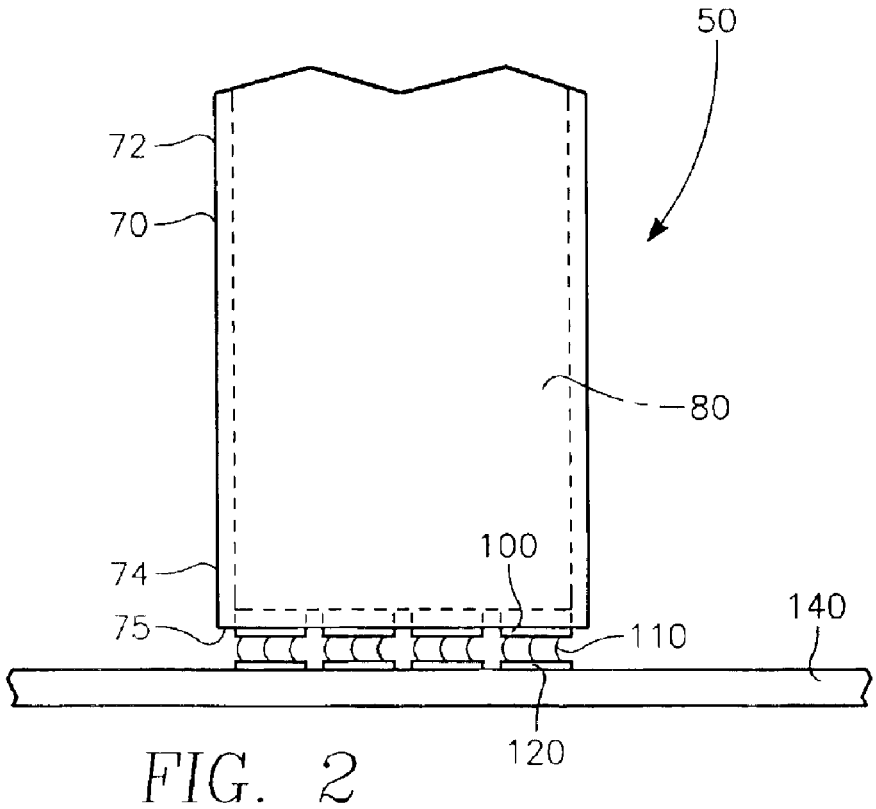
FIG. 2 shows an end portion of one embodiment of the high power-interface of the present invention.

FIG. 2 shows an end portion of one embodiment of the high power interface 50 of the present invention. In this embodiment, a laminated cable 70 includes layers of planar conductive material 80 (shown by dashed lines), laminated with dielectric material. A contact end 75 of the laminated cable 70 is provided with surface contact pads 90. The contact pads 100 extend along the contact end and selectively contact the laminated conductor layers 80, as discussed further below. A compliant connection, such as an interposer 110, may be utilized to electrically couple the contact pads 100 of the laminated cable 70 to the contact pads 120 of a distribution board such as a DIB 140.

To minimize inductance, each of the conductor planes is separated by a dielectric material distributed along the length of the cable 70. Further, the cable is configured such that successive conductor planes provide either a force or a return path. Thus, every other conductor plane is either a force or a return path.

Figure 3:
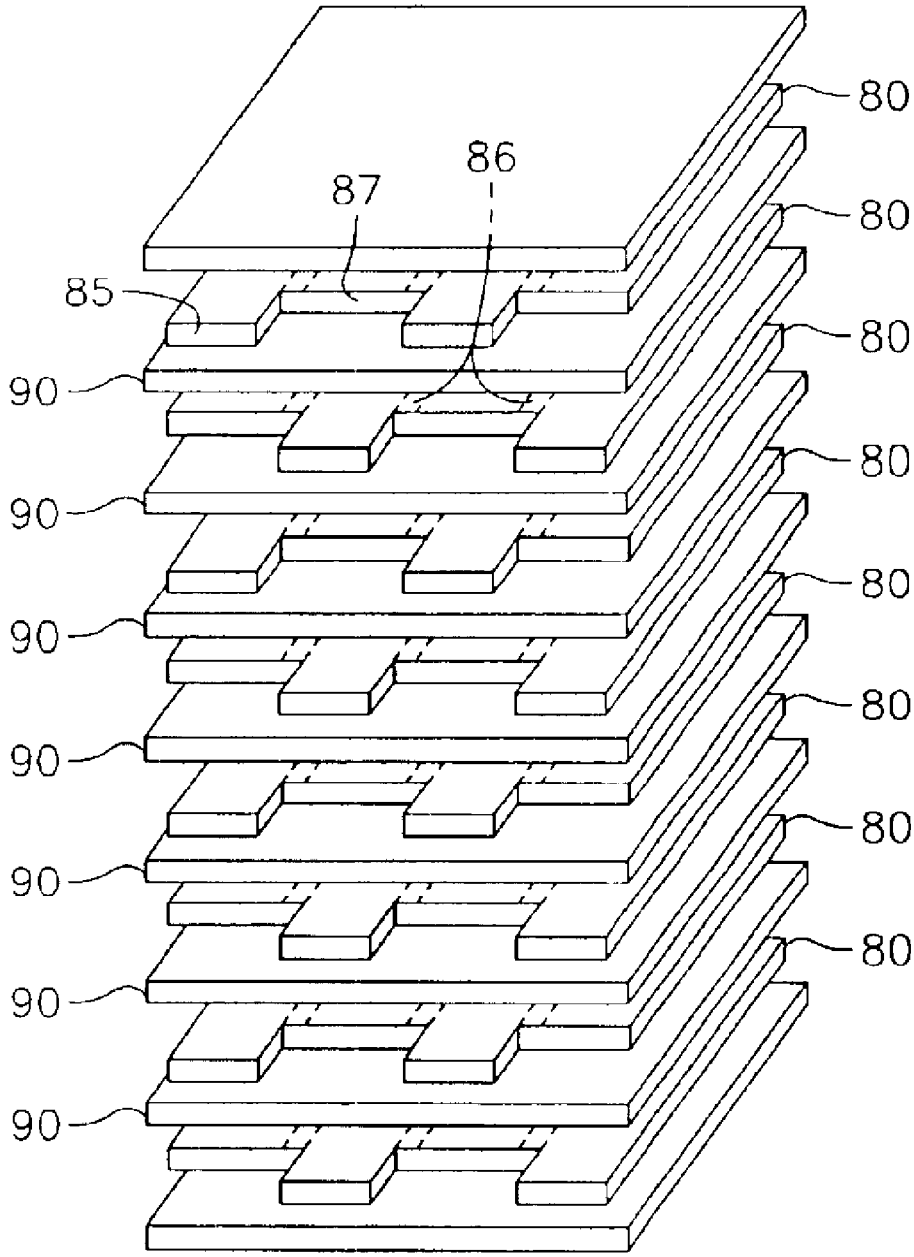
FIG. 3 shows an exploded perspective view of a partially fabricated portion of a laminated cable in accordance with an embodiment of the present invention.

FIGS. 3–7 show some possible implementations in accordance with the present invention. FIG. 3 shows an exploded perspective view of a partially fabricated portion of the laminated cable 70 shown in FIG. 2. Illustrated in FIG. 3 are conductor planes 85 with dielectric planes 90 located in between the conductor planes 85. In this embodiment, the conductor planes 80 each comprise flush portions 85 and recessed portions 87 at the contact end 75 of the laminated cable 70 (shown in FIG. 2).

The flush portions 85 extend to the contact end 75, and the recessed portions 87 are recessed from the contact end 75. The flush portions 85 of every other conductor layer 80 are aligned within the recessed portions 87 such that the flush portions 85 of successive conductor planes 80 are in a staggered configuration. The flush portions 85 of alternating conductor planes 80 are aligned.

In some embodiments, the recessed portions 87 are wider than the corresponding flush portions 85 that are located above and below the recessed portions 87. Thus, in some embodiments, the recessed portions 87 extend beyond the width of the flush portions 85 by a gap 86 amount (shown by phantom lines) along the edges of the flush portions 85. The gaps 86 inhibit formation of electrical continuity between force and return conductor planes by the contact pads 100, or by an interconnection means, such as the interposer 110 (shown in FIG. 2).

The laminate structure of the conductor planes 80 and the dielectric planes 90 may be formed by masking, deposition, and etching techniques typically utilized in forming printed circuit boards. Thus in one embodiment, between the conductor material of adjacent conductor planes, is deposited a prepreg material followed by a polyemet material, followed by prepreg material. The polyemet material may be any dielectric material capable of providing flex in combination with the prepreg material, such as that known by the trademark KAPTON, by DuPont.

Figure 4:
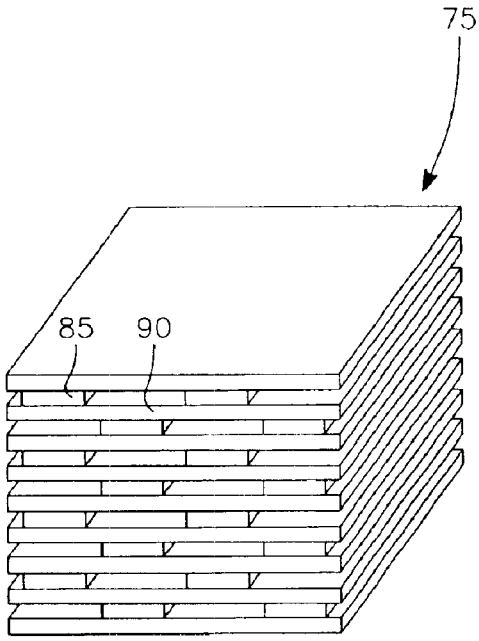
FIG. 4 shows in perspective view a partially fabricated portion of a laminated cable in accordance with an embodiment of the present invention.
Figure 5:
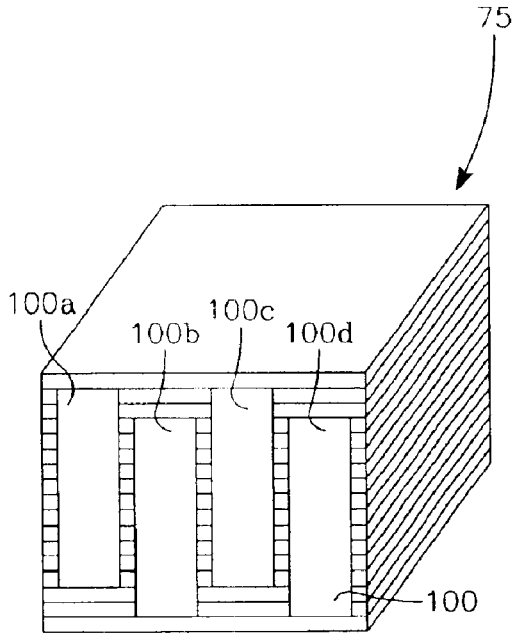
FIG. 5 shows in perspective view a partially fabricated portion of a laminated cable in accordance with an embodiment of the present invention.

FIG. 4 shows the partially fabricated portion of FIG. 3 in unexploded view. The flush portions 85 are shown extending to the contact end 75 of the cable portion, while the recessed portions are removed from it. Turning to FIG. 5, contact pads 100 are provided on the on the contact end 75 to connect aligned flush portions 85. Thus, in this embodiment, two of the contact pads 100*a* and 100*c* are electrically coupled to every other conductor plane, which may for example carry force signals, while the other two contact pads 100*b* and 100*d* are electrically coupled to different alternate conductor planes, which may for example carry return signals.

Figure 6:
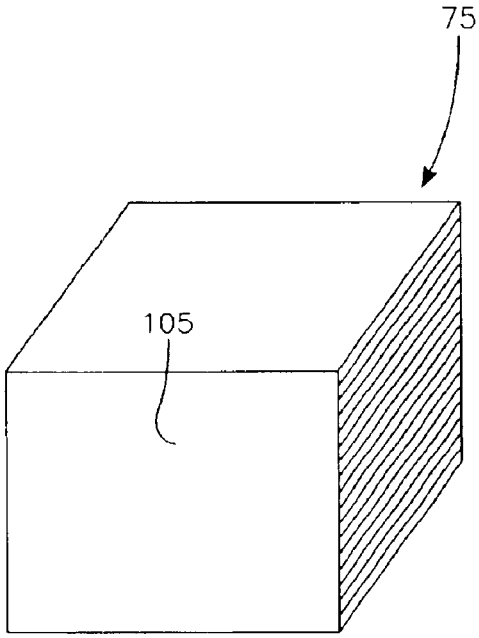
FIG. 6 shows in perspective view a partially fabricated portion of a laminated cable in accordance with an implementation of the present invention.
Figure 7:
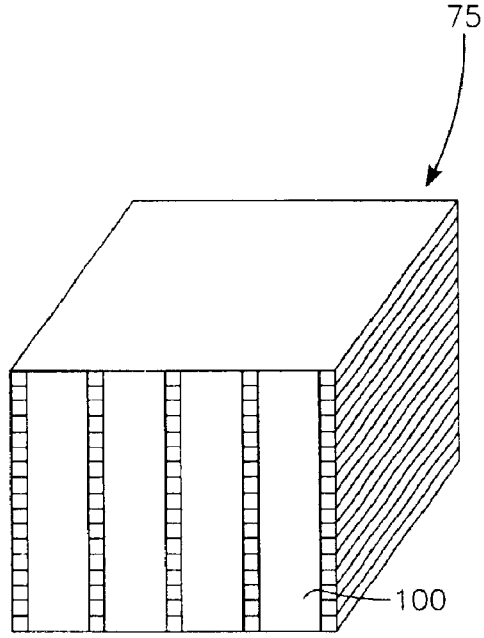
FIG. 7 shows in perspective view a partially fabricated portion of a laminated cable in accordance with an implementation of the present invention.

FIGS. 6 and 7 illustrate a possible implementation for forming the contact pads 100. Referring to FIG. 6, after fabrication of the laminated configuration shown in FIG. 4, the contact end may be plated with conductor material 105. Thereafter, the conductor material is selectively removed, such as by scoring the contact end 75 with a drill, to define the contact pads 100. The removal process may be performed along the gaps 86 (shown in FIG. 3). In this embodiment, the recessed portions 87 form keep-outs, preventing connection of adjacent conductive planes. As a result, contact pads 100 are provided that have electrical connections with alternating conductor planes.

With the above discussed embodiments, improved inductance is obtained by providing alternating stacked planes of force and return separated by dielectric material substantially along the length of the cable. Inductance characteristics of the interface can be further improved by providing multiple force and return contact pads, and by locating the force contact pads beside and interdigitated with the return contact pads. Thus, higher frequency switching of high current signals may be achieved.

Although shown in FIG. 2 as providing an interconnection means at the DIB end of the cable 70, the same means may be utilized to couple to the instrument card 20, shown in FIG. 1.

Referring to FIG. 2, in certain embodiments, an intermediate portion 72 of the laminated cable 70 is flexible, while a portion 74 at the contact end 75 is rigid. The flexible portion 72 facilitates routing and positioning of the cable, while the rigid portion 74 can facilitate retention, mounting, positioning and/or attachment of the cable 70. Thus, in certain embodiments, the interposer 110 may be secured to the cable 70, while in alternate embodiments the interposer may be secured to the board side.

Appropriate prepreg compositions and selective curing processes are utilized during the fabrication process to produce integrally formed rigid and flexible portions 72 and 74. Hence, the flexible portion 72 is fabricated with flexible dielectric material, such as KAPTON. The rigid end 74, on the other hand, may be formed of the same dielectric material, or of a rigid dielectric material, if desired. In this implementation, such a process provides a robust low impedance laminated cable at reduced cost.

In some embodiments, the rigid end 74 will have the same number of conductor planes as the flexible portion 72. In other embodiments, the number of conductor planes in the rigid end 74 will be different than the number of conductor planes in the flexible portion 72.

Figure 8:
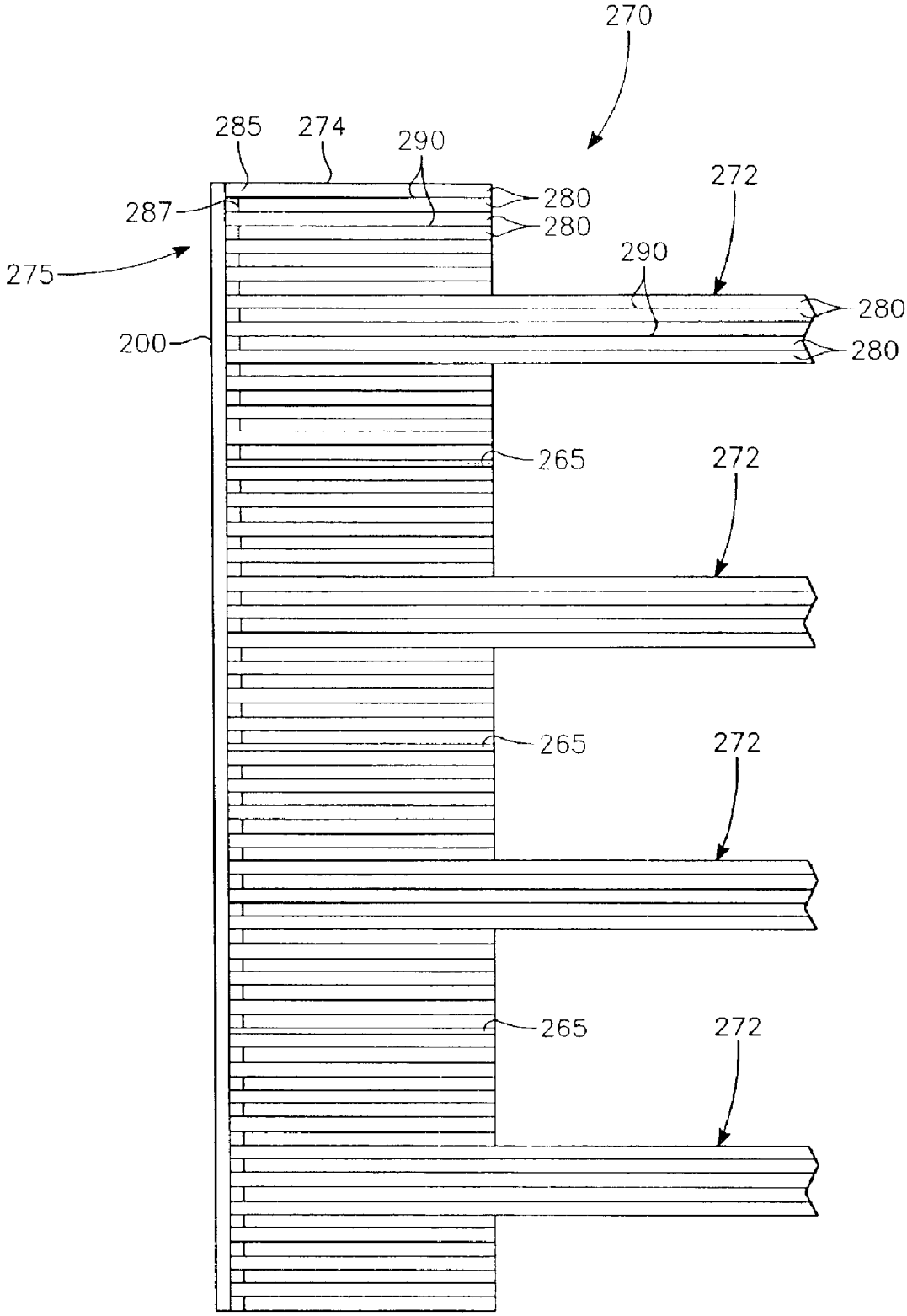
FIG. 8 shows a cross-sectional side view of a laminated cable in accordance with an embodiment of the present invention.

FIG. 8 shows a cross-sectional side view of a laminated cable 270 in accordance with an embodiment of the present invention. In this illustration, the dielectric planes are illustrated by the lines 290 separating the conductive planes 280. In this embodiment, the rigid portion 274 has more conductive planes 280 than the flexible portion 272. Through vias (not shown) are provided in the rigid portion 274 to distribute the signal from the flexible portion 272 throughout the corresponding conductor planes in the rigid portion 274. Because alternating conductor planes provide either a force or return path, sets of through vias (not shown) connect alternating conductor planes together within the rigid portion 274 to distribute the signal therethrough. Such a configuration may be employed to further improve the impedance characteristics of the interface.

In one implementation, the through vias (not shown) are formed by drilling and filling after the deposition of the conductor and dielectric planes 280 and 290. Depending on the size and number of conductor planes 280 in the rigid portion 274, the rigid portion may be sliced to reduce the number of layers for the drilling and filling process. Thereafter, the sliced portions may be recombined, such as with an adhesive 265, or other fastening means. In such an implementation, an alignment hole, aperture, key, surface, or other such means (not shown) is provided along the rigid portion 274 to facilitate recombination of sliced portions.

Contact pads may be formed on the end 275 of the cable 270 as discussed above. Contact pad 200 is shown contacting the flush portion 285 of alternating layers of the conductor planes 280. The recessed portions 287 are recessed from the contact pad 200 shown in FIG. 8.

One or both ends of the laminated cable may be provided with contact pads as discussed with reference to FIGS. 2–7 or 8. In other embodiments, one or both ends of the laminated cable may be provided with alternative connector means.

Figure 9:
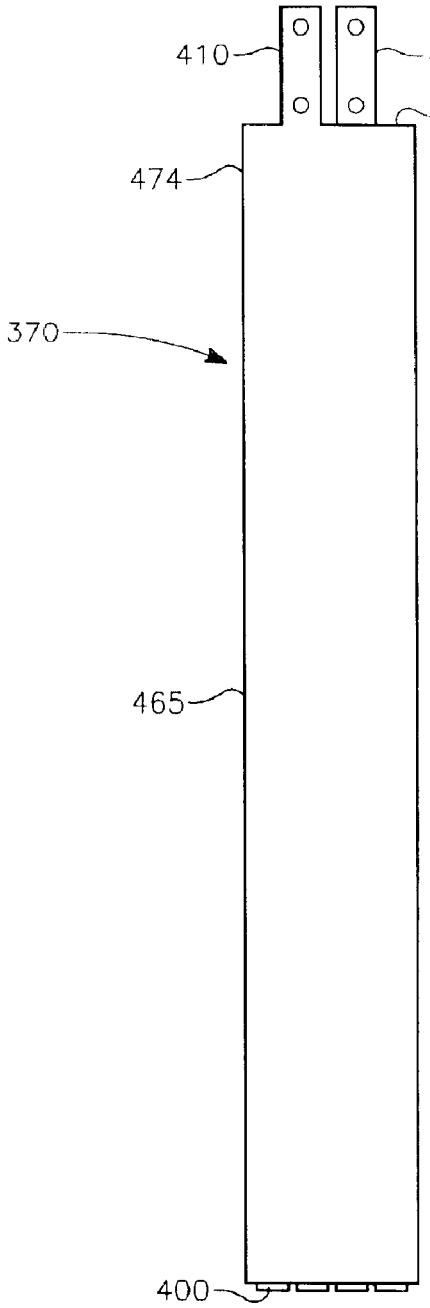
FIG. 9 shows a top view of a laminated cable in accordance with a possible embodiment of the present invention.
Figure 10:
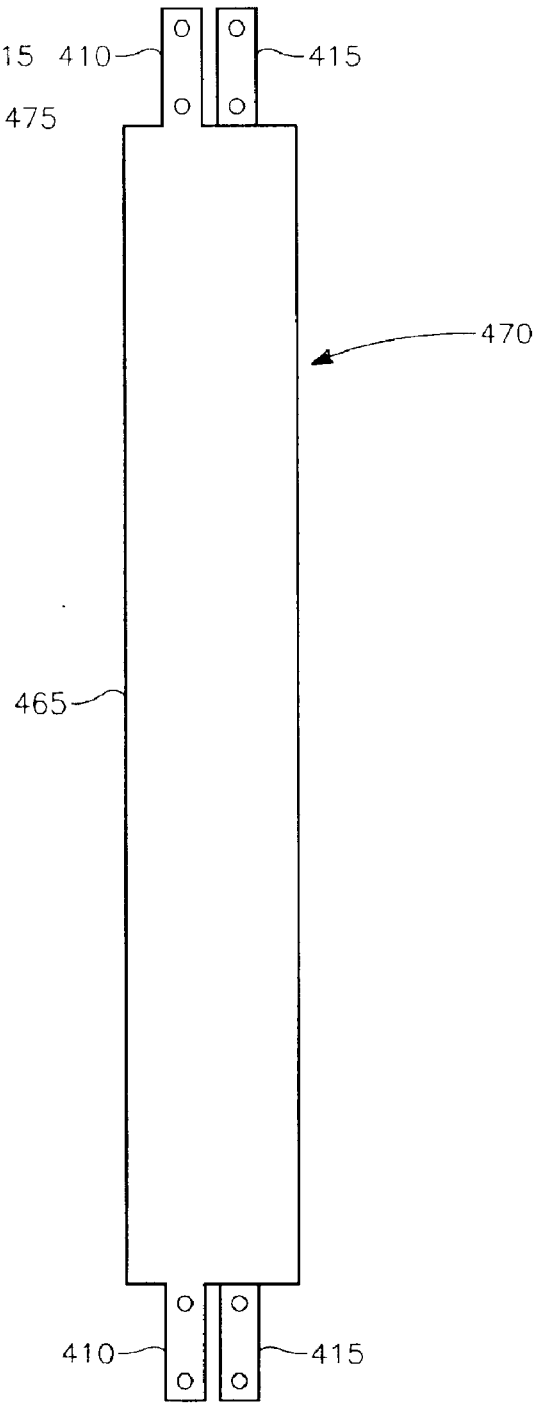
FIG. 10 shows a top view of a laminated cable in accordance with a possible embodiment of the present invention.

Turning to FIG. 9, in one embodiment, the laminated cable 370 may have contact pads 400 at one end as discussed above, and tab extensions 410 and 415 at the opposite end of the laminated cable 370. Each conductor plane in the flexible portion 465 may have a corresponding tab extension 410 or 415. In the embodiments of FIGS. 9 and 10, tab extensions 410 and 415 extend from conductor planes at the ends of the cable 475. The tab extensions 410 and 415 provide force and return path contacts located on either side of a central axis (not show). Thus, alternating conductor layers have tab extension on the same side of the central axis (not shown), with successive tab extensions being located on opposite sides of the central axis (not shown).

The tab extensions 410 and 415 may be integrally formed with the conductor planes of the flexible portion 465 to provide straight through connection, or they may provide a distributed connection as discussed with reference to FIG. 8. The tab extensions 410 and 415 may be utilized to coupled directly, or via a connector, to a circuit board, such as the instrument card 20 shown in FIG. 1.

Figure 11:
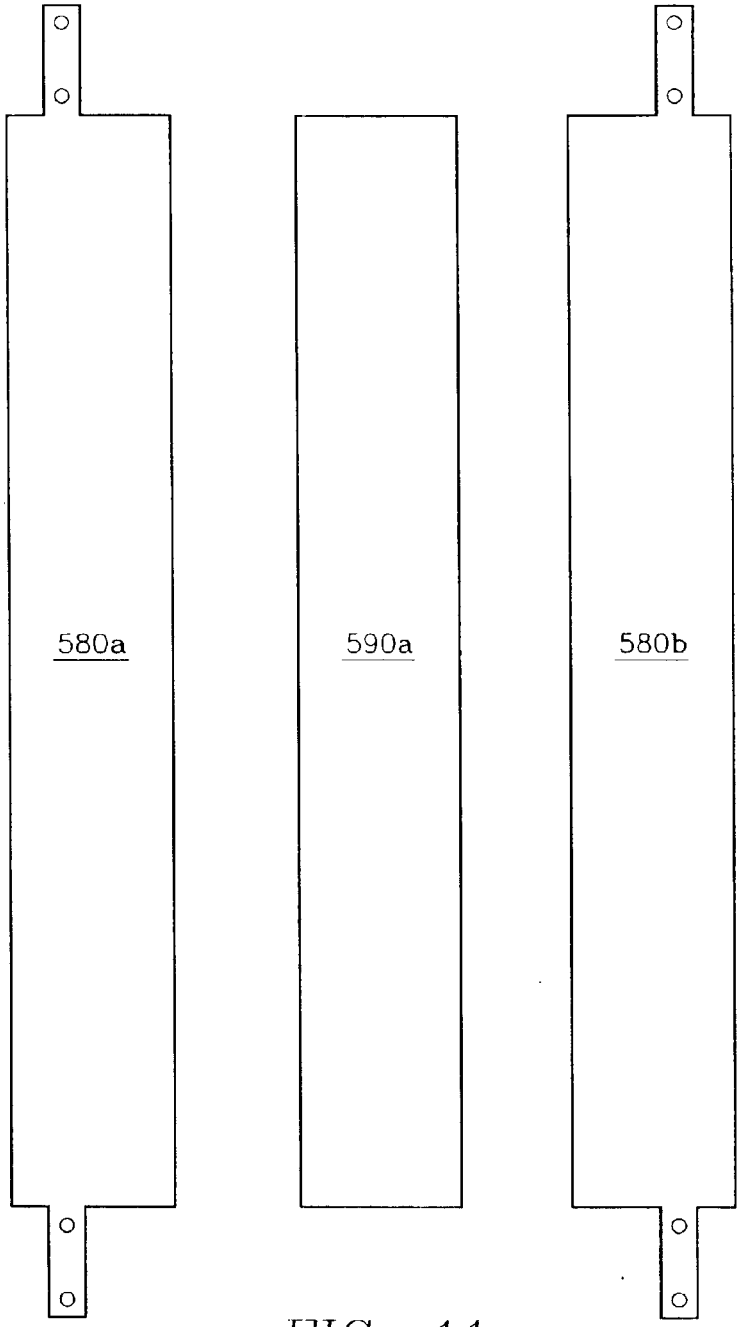

In yet other embodiments as shown in FIG. 10, the laminated cable 470 may have tab extension 410 and 415 extending from both ends of the laminated cable 465. FIG. 11 is a simplified illustration of the laminated layers of the embodiment of FIG. 10 prior to fabrication. The conductor planes 580*a* and 580*b* are laminated with a flexible dielectric plane 590*a*. One plane, 580*a* for example, provides a force signal, while the other plane 580*b* provides a return path. Although only two conductor planes 580*a* and 580*b* are shown, the laminated cable may have many conductor planes.

Figure 12:
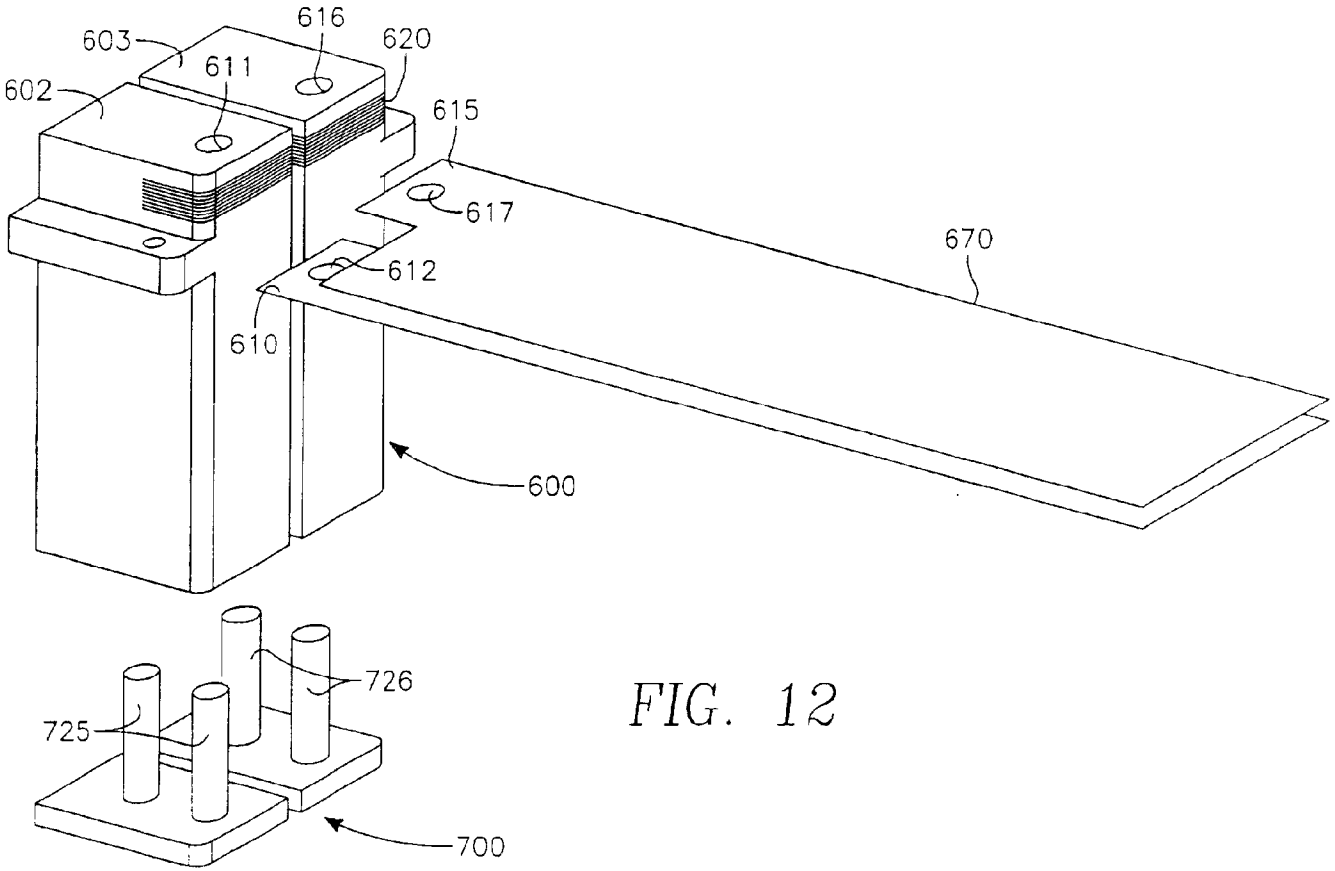
FIG. 12 shows a perspective view of a possible embodiment in accordance with the present invention.

Turning to FIG. 12, a connector 600 may be provided to couple the laminated cable 670 (shown partially constructed) to a circuit board connection 700. The connector 600 is configured with slits capable of receiving the tab extensions 610 and 615. Holes 611 and 616 in the connector 600 along with holes 612 and 617 in the tab extensions 610 and 615, facilitate alignment and retention of the of the cable 670 with the connector 600. After insertion of the tab extensions 610 and 615, screws, pins, solder, conductive adhesive, or the like may be used to retain the cable 670 in the connector 600.

The connector 600 has two electrically isolate portions 602 and 603 for receiving tab extension from alternating layers, and thus corresponding to the force and return paths of the conductor planes. The connector 600 is adapted so that the isolated portions 602 and 603 couple signals to pins 725 and 726, such as those known under the trademark HYPERTRONICS manufactured by Hypertronics of Hudson, Mass. Although only two portions 602 and 603 are shown, other configurations with four or more portions are also envisioned.

Figure 13:
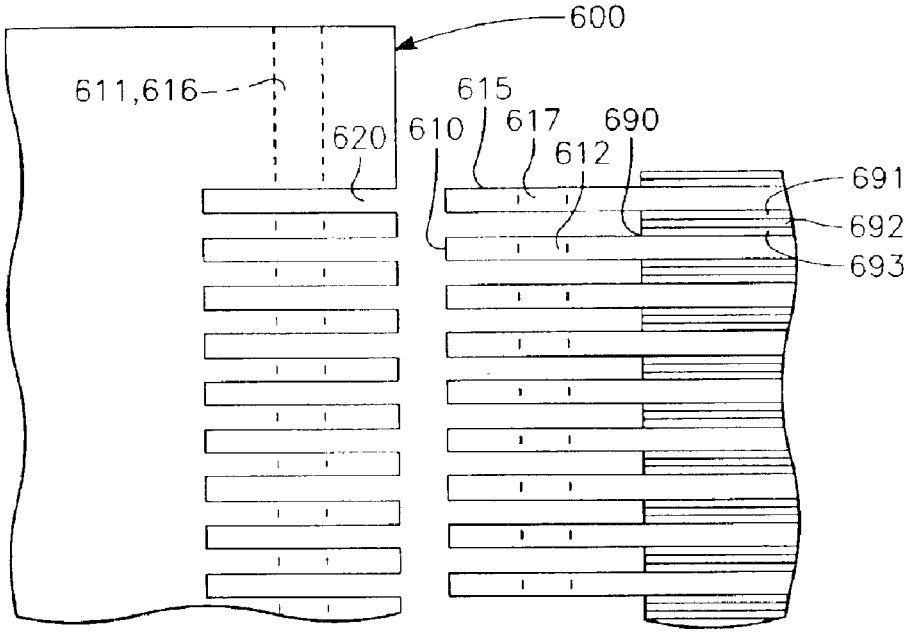
FIG. 13 shows a partial cross sectional side view of the embodiment of FIG. 12.

FIGS. 13 shows a partial cross sectional side view of the slits 620 of FIG. 12. The connector 600 has slits 620 adapted to receive the tab extensions 610 and 615 as illustrated. The tab extensions extend beyond the dielectric material 690. The dielectric material is illustrated as prepreg layers 691 and 693 with a flexible dielectric material 692 between the prepreg layers 691 and 693.

Figure 14:
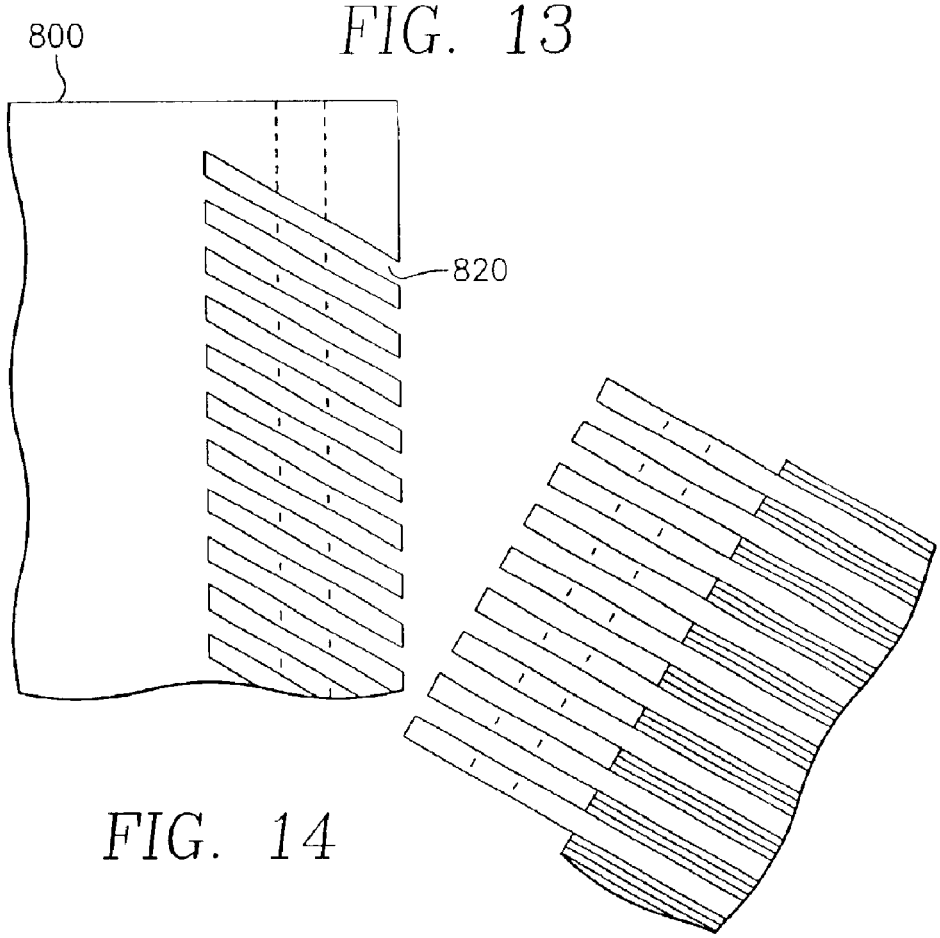
FIG. 14 shows a partial cross sectional side view of an alternate embodiment to the embodiment of FIG. 13.

FIG. 14 shows a partial cross sectional side view of an alternate embodiment of the slits 820. In this embodiment, the slits 820 are acutely angled with respect to the surface of the connector. The acutely angled slits 820 can reduce the amount of bending required by the laminated cable. This is advantageous in embodiments where extreme bending, such as 90 degrees or more, of thick conductor planes is necessary in a particular application. For example, certain bus bar applications require several 90 degree bends between connection points, such as in a right angle "Z" configuration. In embodiments with thick conductor planes laminated with the flexible dielectric, a semi-rigid, but flexible laminated cable is provided. In such implementations, the amount of bending required may be alleviated by angling the slits, either acutely, or obtusely as required, to reduce cable bend, thereby reducing the associated inductance.

In some embodiments, one end of the laminated cable may be provided with the connections means discussed with reference to FIGS. 10–13 or 14, while the other end is provided with a conventional connector means. In other embodiments, one end of the laminated cable may be provided with the contact pads as discussed with reference to FIGS. 2–7 or 8, while the other end is provided with a conventional connector means.

While the preferred embodiments of the present invention have been described in detail above, many changes to these embodiments may be made without departing from the true scope and teachings of the present invention. The present invention, therefore, is limited only as claimed below and the equivalents thereof.

What is claimed is:

1. A high power interface apparatus comprising:

a multilayer laminated cable comprising:

a contact end;

a flexible portion;

a rigid portion positioned between the contact end and the flexible portion, the rigid portion and the flexible portion comprising:

force conductor planes comprising flush and recessed portions, the flush portions extending to the contact end and the recessed portions being removed from the contact end, the flush portions being aligned along axes at the contact end;

return conductor planes comprising flush and recessed portions, the flush portions of the return conductor planes extending to the contact end and the recessed portions of the return conductor planes being removed from the contact end, the flush portions of the return conductor planes being aligned at the contact end along axes aligned within recessed portions of the force conductor planes; and dielectric material separating the force and return conductor planes; and surface contact pads on the contact end, the surface contact pads comprising;

force contact pads contacting and extending along aligned flush portions of the force conductor planes; and return conductor pads each contacting and extending along aligned flush portions of the return conductor planes.

2. The apparatus of claim 1 wherein the force and return conductor planes of the flexible portion and corresponding ones of force and return conductor planes of the rigid portion are formed of a continuous conductive material layer.

3. The apparatus of claim 1 further comprising vias through the rigid portion, the vias electrically coupling the force conductor planes together and electrically coupling the return conductor planes together.

4. The apparatus of claim 1 wherein the force and return conductor planes are stacked in alternating force and return layers.

5. The apparatus of claim 4 wherein the force contact pads are located beside and interdigitated with the return contact pads.

6. The apparatus of claim 1 further comprising an interposer coupled to the contact end of the laminated cable.

7. The apparatus of claim 1 wherein the laminated cable further comprises a second contact end comprising surface contact pads comprising:

(i) force contact pads contacting and extending along aligned flush portions of the force conductor planes at the second contact end; and (ii) return conductor pads contacting and extending along aligned flush portions of the return conductor planes at the second contact end.

8. The apparatus of claim 1 wherein the laminated cable further comprises a second contact end comprising:

a) contact tabs extending from the second end of the laminated cable, the force and return conductor planes and being integrally formed with a contact tab, the contact tabs of the force and return conductor planes being in a staggered configuration such that the force contact tabs are located on one side of an axis of separation and the return contact tabs are located on the other side of the axis of separation; and b) a rigid end connector adapted to receive a plurality of the contact tabs in electrically isolated portions so that the contact tabs from one side of the axis of separation are received in one of the electrically isolated portions and the contact tabs from the other side of the axis of separation in an other of the electrically isolated portions.

9. A high power interface apparatus comprising:

a) a rigid end portion comprising:

(i) conductor planes each comprising flush portions and recessed portions at a contact end of the rigid end portion, the flush portions extending to the contact end and the recessed portions being recessed from the contact end, succeeding conductor planes having the flush portions aligned within the recessed portions such that the flush portions of successive conductor planes are in a staggered configuration and such that the flush portions of alternating conductor planes are aligned; and (ii) dielectric planes located between each of the conductor planes of the rigid end portion;

b) surface contact pads each contacting and extending along the aligned flush portions; and c) a flexible portion coupled to the rigid end portion comprising:

(i) conductor planes coupled to respective ones of the rigid end conductor planes; and (ii) dielectric planes located between each of the conductor planes of the flexible portion.

10. The apparatus of claim 9 wherein the rigid end portion further comprises vias electrically coupling alternating conductor planes of the rigid end portion.

11. The apparatus of claim 9 wherein the rigid end portion further comprises vias electrically coupling alternating conductor planes of the rigid end portion.

12. The apparatus of claim 9 wherein the rigid end portion further comprises vias electrically coupling alternating conductor planes of the rigid end portion so as to form two electrical paths each comprising a plurality of the conductor planes.

13. The apparatus of claim 9 wherein each of the conductor planes of the flexible portion and corresponding ones of the conductor planes of the rigid end portion are formed from a continuous conductive material layer.

14. The apparatus of claim 9 wherein the dielectric planes located between each of the conductor planes of the rigid end portion are formed of a rigid dielectric material, and wherein dielectric planes located between each of the conductor planes of the flexible portion are formed from a flexible dielectric material.

15. The apparatus of claim 9 further comprising:

a) a second rigid end portion coupled to second and distal end of the flexible portion, the second rigid end portion comprising a plurality of conductor planes having flush and recessed portions, the plurality of conductor planes being laminated with dielectric planes therebetween; and b) surface contact pads each contacting and extending along aligned flush portions of the conductor planes of the second rigid end portion.

16. A high power interface apparatus comprising:

a flexible multilayer laminate portion comprising:

conductor material planes in a stacked configuration; and flexible dielectric material between the conductor material planes:

a contact tab extending from the conductor material planes and being integrally formed therewith, contact tabs of successive conductor planes being in a staggered configuration such that successive contact tabs are located on either side of an axis of separation; and a rigid end connector adapted to receive a plurality of the contact tabs in electrically isolated portions so that the contact tabs from one side of the axis are received in one of the electrically isolated portions and the contact tabs from the other side of the axis in an other of the electrically isolated portions;

wherein the rigid end connector comprises a plurality of slits extending through the electrically isolated portions, the slits are configured with an acute angle with respect to a surface adjacent the plurality of slits.

17. A high power interface apparatus comprising:

a flexible multilayer laminate portion comprising:

conductor material planes in a stacked configuration; and flexible dielectric material between the conductor material planes;

a contact tab extending from the conductor material planes and being integrally formed therewith, contact tabs of successive conductor planes being in a staggered configuration such that successive contact tabs are located on either side of an axis of separation; and a rigid end connector adapted to receive a plurality of the contact tabs in electrically isolated portions so that the contact tabs from one side of the axis are received in one of the electrically isolated portions and the contact tabs from the other side of the axis in an other of the electrically isolated portions;

wherein the rigid end connector comprises a plurality of slits extending through the electrically isolated portions, the slits are configured with an obtuse angle with respect to a surface adjacent the plurality of slits.

18. A high power interface apparatus comprising:

a flexible multilayer laminate portion comprising:

conductor material planes in a stacked configuration; and flexible dielectric material between the conductor material planes;

a contact tab extending from the conductor material planes and being integrally formed therewith, contact tabs of successive conductor planes being in a staggered configuration such that successive contact tabs are located on either side of an axis of separation; and a rigid end connector adapted to receive a plurality of the contact tabs in electrically isolated portions so that the contact tabs from one side of the axis are received in one of the electrically isolated portions and the contact tabs from the other side of the axis in an other of the electrically isolated portions;

wherein the contact tabs further comprise an aperture therethrough, the rigid end connector further comprises an aperture through the electrically isolated portions so that the apertures of the contact tabs are capable of alignment with the apertures of respective one of the contact tabs.

19. The apparatus of claim 18, further comprising a securing means within the aperture securing the contact tabs within the rigid end connector.

20. A high current interface for coupling a semiconductor tester to a device-interface-board, the interface comprising:

a multilayer laminated power cable assembly comprising:

a flexible portion;

a contact end;

a rigid portion positioned between the contact end and the flexible end, the flexible portion and the rigid portion comprising force conductor planes, return conductor planes disposed in parallel relationship with the force conductor planes, and dielectric planes interposed between adjacent force and return conductor planes, the force, return and dielectric planes terminating at a the contact end, the contact end formed with return contact pads and force contact pads, the force and return contact pads respectively coupled to the force and return conductor planes; and an interposer adapted for electrically coupling the contact end to the device-interface-board.

21. A method comprising:

delivering current from an automatic test equipment (ATE) power supply to a device-interface-board, delivering comprising:

interfacing the ATE power supply to the device-interface-board with a multi-layered laminated power cable; the power cable comprising:

a contact end;

a flexible portion;

a rigid portion positioned between the contact end and the flexible portion, the rigid portion and the flexible portion comprising a plurality of force conductor planes disposed in parallel stacked relationship with a plurality of return conductor planes; and routing force and return current on the respective force and return conductor planes.

* * * * *